US005184665A

United States Patent [19]

Boudot

[11] Patent Number: 5,184,665

[45] Date of Patent: Feb. 9, 1993

[54] INTERCONNECTING DEVICE FOR CASTING MOLDED PARTS

[75] Inventor: Daniel Boudot, Saint Remy, France

[73] Assignee: Pont-A-Mousson S.A., Nancy, France

[21] Appl. No.: 750,352

[22] Filed: Aug. 27, 1991

[30] Foreign Application Priority Data

Aug. 27, 1990 [FR] France ..... 90 10798

[51] Int. Cl.[5] ..... B22D 18/04

[52] U.S. Cl. ..... 164/306; 164/337

[58] Field of Search ..... 164/306, 119, 337

[56] References Cited

U.S. PATENT DOCUMENTS

| | | | |
|---|---|---|---|
| 2,852,822 | 9/1958 | Strom | 164/306 |
| 4,133,370 | 1/1979 | Bellocci et al. . | |
| 4,475,721 | 4/1984 | Pamart . | |

FOREIGN PATENT DOCUMENTS

| | | |
|---|---|---|
| 0152754 | 6/1985 | European Pat. Off. . |
| 1156942 | 10/1963 | Fed. Rep. of Germany . |
| 1187724 | 2/1959 | France . |
| 2289279 | 7/1976 | France . |
| 2378591 | 2/1978 | France . |
| 2534167 | 3/1982 | France . |
| 2556996 | 7/1983 | France . |

*Primary Examiner*—Kuang Y. Lin

*Attorney, Agent, or Firm*—Sughrue, Mion, Zinn, Macpeak and Seas

[57] ABSTRACT

The upper surface of an interconnecting wear device 3 is positioned in contact with the lower surface of a sand mold 1, and is centered under a molten metal feed shaft 12 which opens into the bottom of the mold. The bottom surface of the wear device rests on the upper surface of a vertically upstanding casting nose 4. The wear device comprises a hollow steel collar 7 surrounding a compressed concrete annulus 18, in turn surrounding a refractory clay sleeve 8, and is easily replaced when leakage develops due to thermal shocks, etc.

5 Claims, 1 Drawing Sheet

INTERCONNECTING DEVICE FOR CASTING MOLDED PARTS

BACKGROUND OF THE INVENTION

This invention concerns an interconnecting wear device for implementing the low-pressure casting of molded parts made of metal alloys having a high melting point, such as cast-iron, steel, and superalloys, from a melting furnace or pouring ladle into a sand mold, under the propulsive pressure of a gas and by feeding the mold upwardly from the bottom.

French Patent No. 1,187,724 discloses a tube for the pressurized feed of a mold. The top end of the feed tube is attached to a housing. A mixture fills the empty spaces between the housing and the feed tube, thus forming a joint. A collar is mounted on the top part of the housing. The interconnecting device produced according to this Patent does not prevent or reduce the thermal and mechanical stresses affecting the feed tube. In fact, this device, although positioned on the top section, encloses the tube, which rises to a height equal to that of the device. The cooling of the metal begins at the top. The tube thus undergoes thermal shocks which are more violent than those affecting the device, which is separated from the metal by the thickness of the tube.

Furthermore, during cooling the metal solidifies in the feed tube. This solidified metal is removed mechanically, a procedure engendering mechanical shocks in the tube The combination of thermal and mechanical shocks leads to the rapid wear of the feed tube which, during a first phase, destroys its surface quality, thereby producing leaks, and, during a second phase, requires that the tube be replaced. This repair is costly and requires a lot of time. In fact, the furnace must be shut off and then drained, thus tying up said melting furnace or pouring ladle and mold.

SUMMARY OF THE INVENTION

The present invention attempts to overcome these difficulties and to provide various advantages, which consist basically in reducing wear of the feed tube or of the gate feeding the mold with liquid metal, by eliminating mechanical and thermal shocks in the tube or gate.

Another goal of the invention is the elimination of the risks of leakage of liquid metal. For this purpose, the interconnecting wear device designed to implement the low-pressure casting of molded parts, as described above, has an upper part positioned in contact with the bottom part of the mold, the device being centered over the melt passage opening into the bottom of the mold, and the bottom part of the device being in contact with the top side of the casting nose.

In order to withstand very high temperatures and to support the mold evenly, the wear device comprises a collar having a flat base on its bottom side and an internal hollow cylindrical part which opens at the level of its top and bottom sides, and a cylindrical sleeve made of a heat-resistant material and whose outer casing fits into but is spaced from the interior hollow part of the collar by an annulus of compressed concrete, the top and bottom sides of the sleeve being positioned at the level of the top and bottom sides of the collar.

To ensure impermeability, a joint is interchangeable with respect to both the mold and the wear device.

In one variant which makes it possible to distribute the pressure generated by the weight of the mold, the interconnecting device has a flat top surface and a flat bottom surface, the top surface lying in a plane parallel to the bottom surface, and in the same horizontal plane as the bottom surface of the mold.

The device according to the invention comprises an interior hollow cylindrical element which forms an extension of the gate while maintaining a uniform section, and which is connected to the feed shaft or passage or the mold. Leakage repair can be done quickly by changing only the removable wear device, since it can be easily detached from the casting nose.

In addition, the device comprises an impermeable, heat-resistant junction between the sleeve and the heat-resistant lining of the casting nose gate, such junction being provided by a compressed or rammed earth flange which is crushed when the device is put in place, the flange thus forming the joint.

In order to limit the thermal and mechanical shocks impacting on the device without attacking the gate, the internal hollow part of the device contains, after a casting operation, in its upper portion, all of the solidified metal and dross.

The feed tube which forms the low-pressure gate feeding the impressions in the sand mold defines at least one melt passage opening downwardly, the metal being fed to the mold impressions or cavities from the melt passage by gas pressure that is greater than atmospheric pressure on the free side of the liquid metal contained in an impermeable chamber.

DETAILED DESCRIPTION OF THE PREFERRED EMBODIMENT

Figure 1:
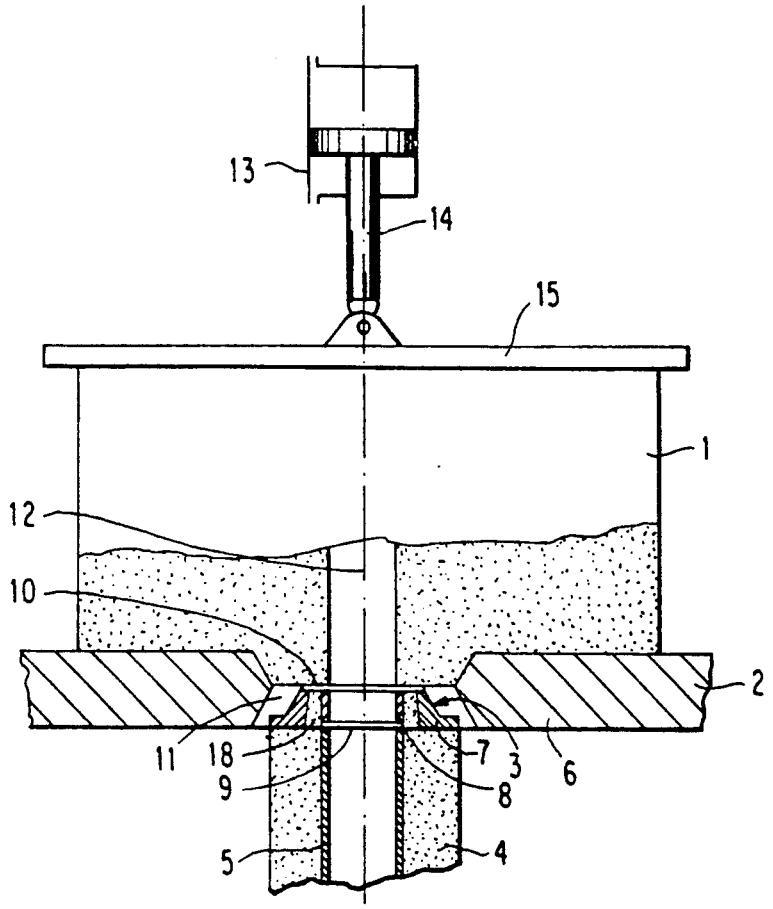
FIG. 1 is a diagrammatic representation, in vertical crosssection, of an interconnecting wear device according to the invention.

The casting equipment shown in FIG. 1 comprises a sand mold 1 held on a mold-support plate 2, and an interconnecting wear device 3 installed at the end of a feed tube 5 embedded in a casting nose 4 of a furnace.

The wear element 3 is applied to the ascending low-pressure casting flow of a superalloy identical to those described in commonly assigned French Patent No. 2,534,167. The invention is also applicable to the ascending low-pressure casting flow of castiron (gray or ductile cast-iron) or steel.

The feed tube 5, which is made of a heat-resistant material and channels the liquid metal to the mold, is embedded in a nose 4 of rammed earth or refractory clay. The junction between the feed be 5 and the mold 1 is formed by the interconnecting wear device 3. The top side of the casting nose 4 is flat and horizontal; it supports the interconnecting device 3.

The device 3 comprises a collar 7 incorporating a base flange in its bottom section, which is placed on and covers the casting nose. It further comprises a heat-resistant sleeve 8 made of a refractory clay such as a basic aluminous magnesian earth and having the same interior and exterior diameter as the tube 5, so that it forms an extension thereof. The junction between the tube 5 and the sleeve 8 is formed by a ramed earth flange joint 9. The interconnecting device 3 crushes the joint 9 when it is put in position. The joint 9 is also made of refractory clay.

Because of its base flange, the top part of the collar 7 has a smaller diameter than its bottom part The collar 7 is made of cast heat-resistant steel. The interconnecting device is baked to harden a clay annulus 18 between the collar 7 and the sleeve 8.

A flat, flexible, annular joint 10 made of a heat-resistant material is positioned at the upper part of the wear device 3. This joint 10, as described, for example, in commonly assigned U.S. Pat. No. 4,133,370, ensures impermeability in conjunction with the mold. The flexibility of the joint 10 allows it to remain in position by means of pressure and without coating. This joint is clamped on its top side by the mold 1 and, on its bottom surface, by the collar 7 and the sleeve 8.

The top and bottom sides of the interconnecting device each lie in a plane parallel to the bottom of the mold 1. Because of this geometry, the risk of leakage is eliminated, since the mold is supported evenly and cannot be pressed down more strongly on one side, which would give rise to leakage. Impermeability is also obtained because of the good contact surface quality of the interconnecting device which, since it is inexpensive and removable, is replaced frequently at the first sign of leakage.

The interconnecting wear device is housed inside an opening 11 in the mold-support plate 2, which enables the mold 1 to be centered and the liquid metal to be fed into a feed shaft 12, which opens into the bottom section of the mold 1. The sand mold 1 is held in position by a jack 13 directed downwardly and whose piston rod 14 has a support plate 15 pivotally joined to its lower end.

During a casting operation, the liquid metal rises through the tube 5 into the interconnecting device 3, and then into the mold 1. Upon termination of the casting procedure, the metal in the mold solidifies beginning at the top, and stops at a level below the mold represented by the thin line 6. Beneath this level the metal remains in a liquid state after casting, and is fed back into the furnace.

All of the dross lighter than the metal rises to the level of the interconnecting device 3. Similarly, all of the traces of solidified metal congregate at the level of the device 3, which undergoes the first thermal shocks that solidify the metal. Therefore the feed tube 5, which holds no metal after casting, does not have to be cleaned. Because of the cleaning action and the thermal shocks caused by the cooling of the mold 1, the interconnecting device 3 wears out relatively quickly, and can be removed and replaced at a more sustained frequency than the heat-resistant feed tube 5. The device 3 is thus changed relatively frequently, but replacement is rapidly accomplished since it is not necessary to completely cool the furnace. The tube 5 must be cold, however. The joint 10, which wears out faster than the collar 7 and the sleeve 8, is replaced still more frequently.

Figure 2:
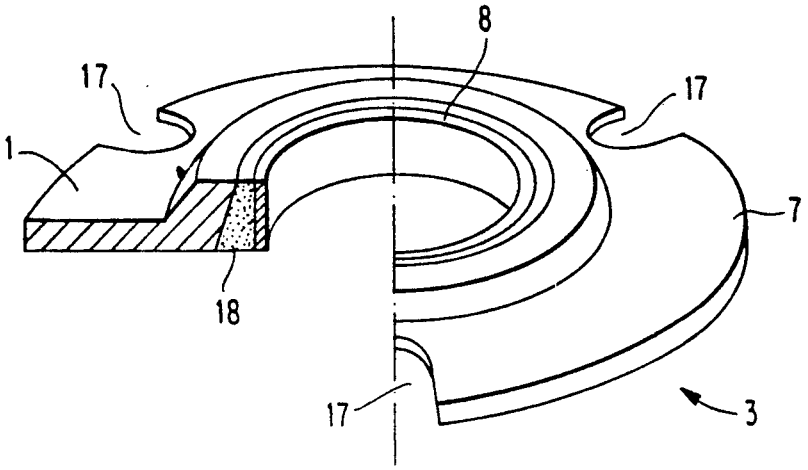
FIG. 2 is a cutaway perspective view of the device formed by the sleeve/collar assembly.

As shown more specifically in FIG. 2, the heat-resistant sleeve 8 has a hollow cylindrical shape, the interior wall of the cylinder having a uniform diameter along its height. The exterior wall of the sleeve 8 is spaced from the interior hollow cylindrical or conical wall of the collar 7 by the interposed annulus is of clay or compressed concrete. The height of the sleeve is identical to that of the collar 7. Notches 17 are provided in the support base of the collar to accommodate attachment screws which fasten the interconnecting device according to the invention.

The interconnecting wear device 3 may be placed on the top side of a gate comprising heating means, as shown in commonly assigned U.S. Pat. No. 4,475,721. The device 3 may also be used in equipment designed for the low-pressure casting of molded parts from a pouring ladle into a mold under the propulsive pressure of a gas, by feeding the mold from the bottom upwardly, the differential pressure being subjected, on the side facing the ladle, to a pressure different from that existing on the side facing the mold. This use of the device reduces the maintenance costs for an equipment installation of this kind, as disclosed in commonly assigned French Patent No. 2,556,996.

I claim:

1. In combination with a casting apparatus, a replaceable, interconnecting device for implementing the casting of molded parts from a metal alloy having a high melting point, such as cast-iron, steel, or a superalloy, from a melting furnace or pouring ladle into a sand mold, by feeding the mold from the bottom upwardly, wherein said device (3) is a wear device, an upper surface thereof is positioned in contact with a bottom section of said mold (1), the device is centered under a feed shaft (12) opening into the bottom of the mold, and a lower surface of the device is disposed in contact with an upper end of a vertically oriented casting nose (4), and wherein said device comprises a collar (7) having a flat base on a bottom side thereof and a hollow cylindrical interior which opens at a level of said upper and lower surfaces, and a cylindrical sleeve (8) made of a heat-resistant material, an exterior casing of said sleeve fitting into the hollow interior of the collar via an interposed annulus of compressed concrete (18), upper and lower surfaces of the sleeve being positioned at the level of the upper and lower surfaces of the collar.

2. Device according to claim 1, wherein said upper and lower surfaces are flat, and lie in spaced, parallel planes.

3. Device according to claim 1, wherein an interior of said sleeve forms an extension of the casting nose while maintaining a uniform section, and is connected to the feed tube of the mold.

4. Device according to claim 1, wherein an impermeable, heatresistant junction between the sleeve and a heat-resistant lining of the casting nose is formed by a rammed earth flange (9) which is crushed when the device is put in position, said flange forming a joint.

5. Device according to claim 1, wherein an interior of the sleeve is capable of containing, at the end of a casting cycle, all of any solidified metal and dross in its upper portion.

* * * * *